US006229976B1

(12) United States Patent
Kimura

(10) Patent No.: US 6,229,976 B1
(45) Date of Patent: May 8, 2001

(54) EXCHANGEABLE TONER CARTRIDGE HAVING AN AUGER AND A REGULATION MEMBER

(75) Inventor: Hisashi Kimura, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/495,705

(22) Filed: Feb. 1, 2000

(51) Int. Cl.[7] ..... G03G 15/08

(52) U.S. Cl. ..... 399/262; 399/260; 399/263; 222/DIG. 1

(58) Field of Search ..... 222/DIG. 1; 399/254, 399/255, 256, 258, 259, 260, 261, 262, 263, 119, 120

(56) References Cited

U.S. PATENT DOCUMENTS 5,017,966 5/1991 Suga .
5,185,616 * 2/1993 Wilcke ..... 346/1.1
5,185,631 * 2/1993 Shibata ..... 399/263
5,875,378 * 2/1999 Campbell et al. ..... 399/263

* cited by examiner

*Primary Examiner*—Arthur T. Grimley
*Assistant Examiner*—Hoang Ngo
(74) *Attorney, Agent, or Firm*—Foley & Lardner

(57) ABSTRACT

The toner cartridge of the present invention has an elongated cylindrical container containing toner and is set at a predetermined position such that the lengthwise axis of the container extends in the substantially horizontal direction. A supply port for dropping and supplying the toner in the container in the gravity direction toward the apparatus body. An auger extended immediately above the supply port in the substantially horizontal direction is provided in the container. The auger rotates thereby feeding the toner from inside the container toward the supply port along the rotary shaft. A plate-like regulation member for restricting drop of the toner in the container toward the supply port due to its dead weight is attached to a position opposed to the supply port above the auger.

27 Claims, 6 Drawing Sheets

EXCHANGEABLE TONER CARTRIDGE HAVING AN AUGER AND A REGULATION MEMBER

BACKGROUND OF THE INVENTION

The present invention relates to a toner cartridge which is set in an image forming apparatus like a copy machine, a printer, or the like and is replaceable, and particularly to a toner cartridge of a type which drops and feeds toner toward the apparatus body through a toner supply port provided immediately under an auger.

In general, in an image forming apparatus such as a copy machine and a printer, a toner cartridge filled with toner is set to be replaceable. The toner cartridge includes a long narrow cylindrical container body containing toner and is set at a predetermined position in the apparatus body such that the lengthwise axis of the container body extends in a substantially horizontal direction.

A toner supply port for dropping toner contained in the container body in the gravitational direction to feed toner to the apparatus body is formed at a bottom portion of the container body which is set laterally. Also, an auger extending immediately above the toner supply port along the lengthwise axis of the container body is provided in the container body. The auger comprises a rotary shaft including a spiral blade which feeds the toner contained in the container body toward the toner supply port.

For example, in case where the toner supply port is formed at a position distant from an end portion of the container body in its lengthwise direction to the center, the spiral directions of spiral blades provided on the rotary shaft of the auger are opposed to each other with respect to a position immediately above the toner supply port as a boundary, and the rotary shaft of the auger is rotated in a predetermined direction, so the toner in the container is collected from both sides to the toner supply port.

However, in this case, at a connecting portion of the blades formed along the rotary shaft in the opposite direction, i.e., at a portion of the auger immediately above the toner supply port, no spiral blade is formed and the rotary shaft is exposed therefrom to drop toner smoothly toward the container body through the toner supply port. As a result, a problem arises in that toner drops through the toner supply port by its dead weight even when the auger is not being rotated. If toner drops thus toward the apparatus body by dead weight even when the auger is not being rotated, it is not possible to achieve fixed-amount supply of toner based on the feed capability depending on the speed of rotation of the auger, so the supply amount of toner cannot be controlled stably. As a result, the supply amount of toner is not stable.

BRIEF SUMMARY OF THE INVENTION

The present invention has been made in view of the above problems and has an object of providing a toner cartridge which can supply toner at a constant rate, without washing the toner.

To achieve the object, a toner cartridge according to the present invention comprises: a container containing toner; a supply port provided at a bottom of the container, for dropping the toner in the container in a gravity direction; an auger provided in the container so as to extend immediately above the supply port in a substantially horizontal direction, for feeding the toner in the container toward the supply port along a lengthwise direction thereof; and a regulation member provided above the auger at a position opposed to the supply port, for regulating drop of the toner in the container toward the supply port due to dead weight of the toner.

Another toner cartridge according to the present invention comprises: a container containing toner; a supply port provided at a bottom of the container, for dropping the toner in the container in a gravity direction; an auger provided in the container so as to extend immediately above the supply port in a substantially horizontal direction, for feeding the toner in the container toward the supply port along a lengthwise direction thereof; a regulation member provided above the auger at a position opposed to the supply port, for regulating drop of the toner in the container toward the supply port due to dead weight of the toner; and a stirring member for stirring the toner in the container and for moving the toner existing above the regulation member along a lengthwise direction of the auger in a direction in which the toner moves apart from the regulation member.

Further, another toner cartridge according to the present invention comprises: a substantially cylindrical container containing toner; a charge port formed at a bottom portion of a substantially circular concave recessed to inside of the container from an end of the container along a lengthwise direction of the container extending in a substantially horizontal direction; a supply port provided at a bottom of the container, for dropping and supplying the toner in the container in a gravity direction; an auger provided in the container so as to extend immediately above the supply port in the substantially horizontal direction along the lengthwise axis and having an end rotatably supported on the end of the container, for feeding the toner in the container toward the supply port along the lengthwise direction; a regulation member provided above the auger at a position opposed to the supply port, for regulating drop of the toner in the container toward the supply port due to dead weight of the toner; and a stirring member extended substantially in parallel with the auger through inside the container and having a rotary shaft rotatably supported, at an end thereof, on a substantially central position of the bottom portion of the concave, for stirring the toner in the container by rotating the rotary shaft, wherein the stirring member has a ion which acts on a groove provided outside the concave in the container vessel as the stirring member rotates.

DETAILED DESCRIPTION OF THE INVENTION

Embodiments of the present invention will be explained in details below with reference to the drawings.

Figure 1C:
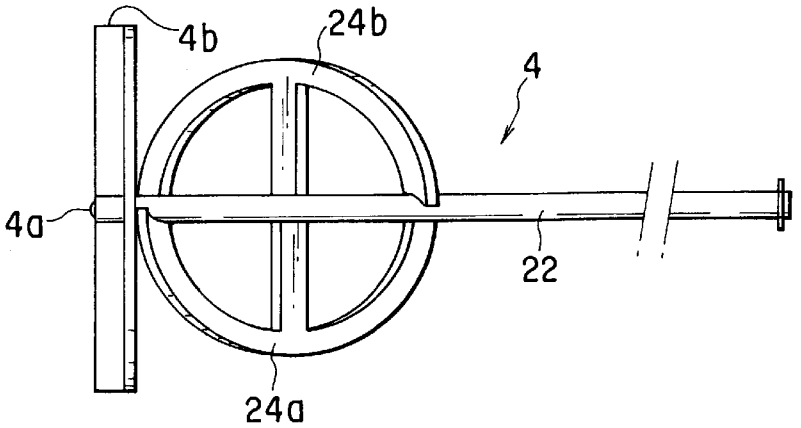
FIG. 1C is a plan view showing a paddle attached in the toner cartridge shown in FIG. 1A.
Figure 1A:
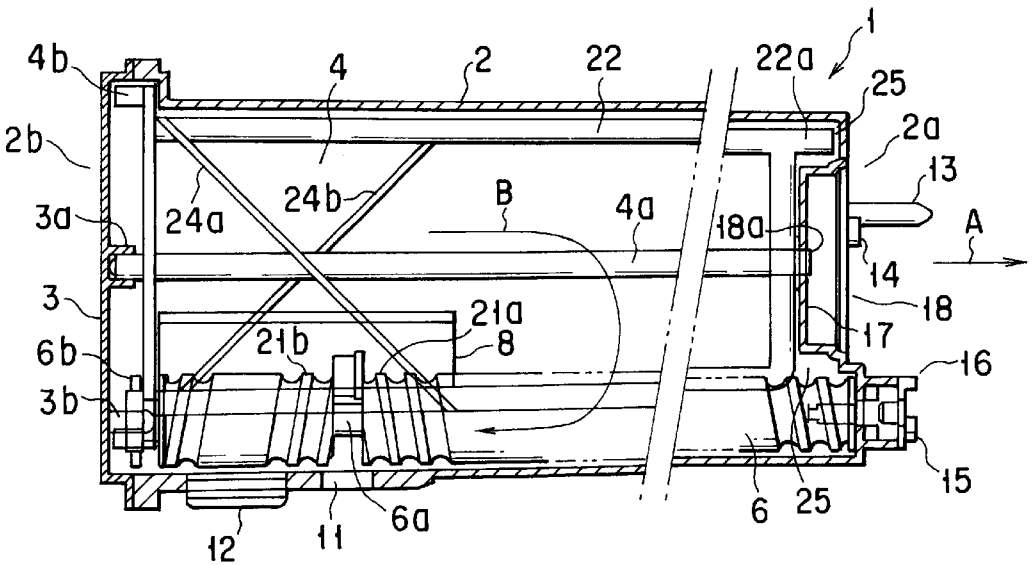
FIG. 1A is a front view showing an inner structure of a toner cartridge according to a first embodiment of the present invention.
Figure 1B:
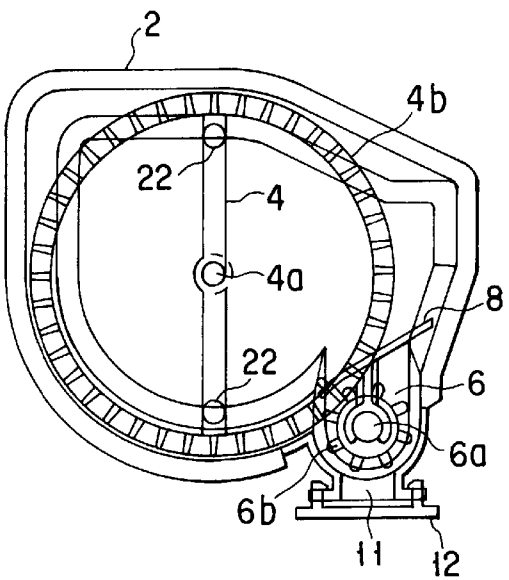
FIG. 1B is a side view of the toner cartridge shown in FIG. 1A as viewed from an end side thereof.

FIG. 1A is a front view showing an inner structure of a toner cartridge 1 according to a first embodiment of the present invention. FIG. 1B is a side view of the toner cartridge 1 shown in FIG. 1A, viewed from the left side in the figure. FIG. 1C is a plan view showing a paddle incorporated in the toner cartridge 1 shown in FIG. 1A.

The toner cartridge 1 is set exchangeably in a predetermined position not shown in the apparatus body of an image forming apparatus such as a copy machine or a printer and functions to supply toner to a development unit not shown but provided in the apparatus body. When the toner cartridge 1 is set in the apparatus body, the toner cartridge 1 is gripped such that its lengthwise axis extends in the horizontal direction, and the cartridge 1 is driven in the direction of the arrow A in FIG. 1A along its lengthwise axis.

The toner cartridge 1 includes a cartridge body 2 (container) having an elongated and substantially cylindrical shape. The cartridge body 2 is formed in a tapered shape which is tapered slightly toward one end 2*a* (the end portion in the right side in the figure) along the lengthwise axis thereof. A cover member 3 is provided in the side of the other open end 2*b* of the cartridge body 2, to enclose this end portion 2*b*.

A paddle 4 as a stirring member which functions to stir toner contained in the cartridge body 2, and an auger 6 for feeding the toner contained in the cartridge body 2 toward a toner supply port 11 described later are installed inside the cartridge body 2. A rotary shaft 4*a* of the paddle 4 and a rotary shaft 6*a* of the auger 6 extend substantially in parallel with the lengthwise axis of the cartridge body 2. The rotary shaft 4*a* and 6*b* are rotatably supported at one end by the end 2*a* of the cartridge body 2 and at the other end by the cover member 3 attached to the end 2*b* of the body 2. Also, a plate-like member 8 described later is attached to the rotary shaft 6*a* of the auger 6.

The paddle 4 is installed in the cartridge body 2, and the auger 6 equipped with a plate-like member 8 is installed in the cartridge body 2. Thereafter, the cover 3 is attached to the end 2*b* of the cartridge body 2, and toner is filled in the cartridge 2. Then, the toner cartridge 1 is inserted into the apparatus body such that the side of the tapered end 2*a* of the cartridge body 2 enters first.

A toner supply port 11 for dropping and supplying the toner contained in the cartridge body 2 in the gravitational direction to a development unit not shown is formed at the bottom of the cartridge body 2. In the present embodiment, the toner supply port 11 is formed to be deviated to the near side (left side in the figure) along the inserting direction (in the arrow A) of the toner cartridge 1, i.e., to the side of the end 2*b* of the cartridge body 2.

A cover member 12, which is opened when the cartridge body 2 is driven in the direction of the arrow A and is attached to the apparatus body, is slidably provided at the toner supply port 11. A seal member not shown made of an elastic member such as rubber or the like is adhered to the inner surface side where the cover member 12 faces the toner supply port 11. When the cover member 12 shuts the toner supply port 11 tightly, this seal member functions to make sealing between the cover member 12 and the toner supply port 11. Note that FIG. 1A shows a state where the toner cartridge 1 is attached inside the apparatus body and the cover member 12 is opened by the toner supply port 11.

Figure 2:
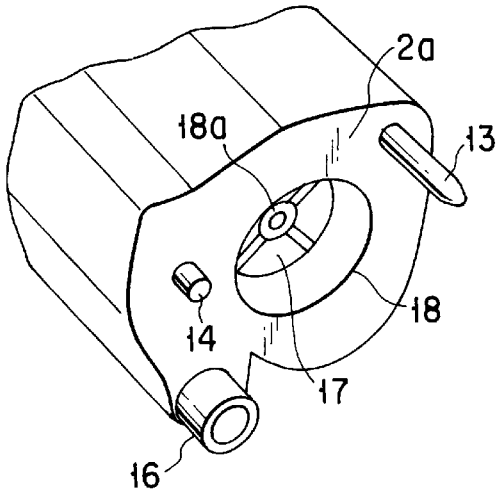
FIG. 2 is a perspective view of the toner cartridge in FIG. 1A as viewed from another end side thereof.

As shown in FIG. 2, a boss portion 16 is projected at the end 2*a* of the cartridge body 2 and contains a bearing portion 15 which receives an end of the rotary shaft 6*a* of the auger 6 as well as pins 13 and 14 which function as positioning members with respect to the apparatus body when the toner cartridge 1 is attached to the apparatus body. When the toner cartridge 1 is driven toward the apparatus body in the direction of arrow A and is attached to the apparatus body, the pins 13 and 14 and the boss portion 16 are received in concave portions not shown but provided so as to correspond to the pins and portion, respectively. At this time, a driving shaft of a motor not shown is inserted from the side opposite to the bearing portion 15 which has received an end of the rotary shaft 6*a* of the auger 6, and the driving shaft of the motor is connected to the rotary shaft 6*a* of the auger 6. That is, in a state where the toner cartridge 1 is attached to the apparatus body, a driving force of the motor not shown can be transmitted to the rotary shaft 6*a* of the auger 6.

Further, a toner charge port 17 for supplying toner into the cartridge body 2 is provided at the end 2*a* of the cartridge body 2. The toner charge port 17 is formed at a bottom portion of in a substantial circular concave portion 18 recessed inside from the end 2*a* of the cartridge body 2. Also, at the center of the bottom portion of the concave portion 18, a bearing 18*a* for rotatably supporting an end of the rotary shaft 4*a* of the paddle 4 is formed. After charging toner to the cartridge body 2 through the toner charge port 17, a cap not shown is attached to the concave portion 18 and the toner supply port 17 is thereby closed.

Inside of the cover member 3 attached to close the opposite end 2*b* of the cartridge body 2, a cylindrical bearing portion 3*a* rotatably supporting another end of the rotary shaft 4*a* of the paddle 4 and a support pin 3*b* engaged in another end of the rotary shaft 6*a* of the auger 6 are provided and projected. Further, a gear 4*b* which meshes with a gear 6*b* attached to the other end side of the rotary shaft 6*a* of the auger 6 is attached in the other end side of a rotary shaft 4*a* of the paddle 4. That is, the drive torque of the auger 6 being rotated and driven by a motor not shown is transmitted to the paddle 4 through the gears 4*b* and 6*b*, so that the auger 6 is rotated in a predetermined direction and the paddle 4 is also rotated in a predetermined direction.

Meanwhile, the auger 6 attached in the cartridge body 2 is provided so as to pass immediately above the toner supply port 11 and extend close to the bottom of the cartridge body 2. An end of the rotary shaft 6*a* of the auger 6 is supported rotatably by the bearing portion 15 provided at an end 2*a* of the cartridge body 2 and the support pin 3*b* projected inside the cover member 3 is inserted into the other end of the rotary shaft 6*a*.

A first spiral blade 21*a* and second spiral blade 21*b* wound in directions opposite to each other are provided on the rotary shaft 6*a* of the auger 6. The first and second blades 21*a* and 21*b* are respectively spiraled in opposite directions. The blades 21*a* and 21*b* oppose at a position right above the toner supply port 11 that is slightly distant from the other end 2*b* of the cartridge body 2 as a dividing point. That is, by rotating the rotary shaft 6*a* of the auger 6 in a predetermined direction, toner is collected from both end sides toward the toner supply port 11 along the rotary shaft 6*a* of the auger 6 due to the function of the first and second blades 21*a* and 21*b*.

At a connecting portion between the first and second blades 21*a* and 21*b*, i.e., the part of the auger 6 positioned immediately above the toner supply port 11, no spiral blade is formed and the rotary shaft 6*a* is exposed. Thus, by exposing the rotary shaft 6*a* of the auger 6 positioned immediately above the toner supply port 11, toner existing above the toner supply port 11 is dropped smoothly and the supply efficiency can thereby be improved. Note that the auger 6 is formed in a shape slightly tapered toward one end (e.g., the right end portion in the figure).

Figure 3A:
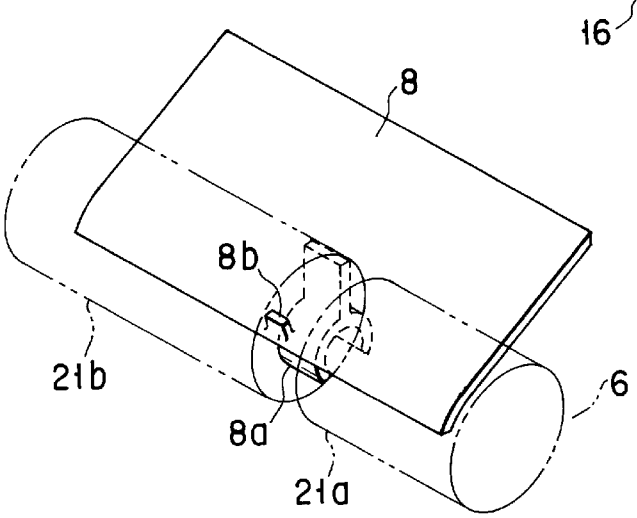
FIG. 3A is a schematic view showing a plate-like member attached in the toner cartridge shown in FIG. 1A.
Figure 3B:
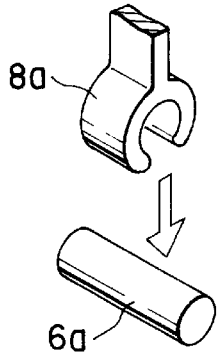
FIG. 3B is a view showing an installation portion of the plate-like member shown in FIG. 3A.

As shown in FIG. 3A and 3B, a plate-like member 8 (regulation member) is rotatably attached, through a support arm 8*a*, on the rotary shaft 6*a* of the auger 6 exposed above the toner supply port 11. The support arm 8*a* is attached rotatably with a slight margin with respect to the rotary shaft 6*a*. The plate-like member 8 is provided above the auger 6 in a manner that the member 8 covers the exposed rotary shaft 6*a* of the auger 6, that is, covering the upper side of the toner supply port 11. The plate-like member 8 is slanted along a direction crossing the rotary shaft 6*a*. Specifically, the plate-like member 8 is attached and slanted so that the toner existing above the plate-like member 8 is fed to the paddle 4 along the slanting surface (see FIG. 1B). In the present embodiment, although the plate-like member 8 is slanted toward the paddle 4, it may be slanted such that toner is fed toward the exposed portion of the first blade 21*a*.

The plate-like member 8 has a width enough to overlap substantially the total length of the second blade 21*b* in the other end side of the auger 6 and also a part of the first blade 21*a*. The width by which the plate-like member 8 overlaps the blades 21*a* and 21*b* of the auger 6 is appropriately set depending on the fluidity of toner, and the position of the toner supply port 11 along the axial direction thereof. The plate-like member 8 in the present embodiment is set to such a width that covers the substantial total length of the second blade 21*b* in the opposite end side of the auger 6, and the other portion of toner than the portion which existed around the second blade 21*b* at the time of initialization is not substantially fed.

Figure 4:
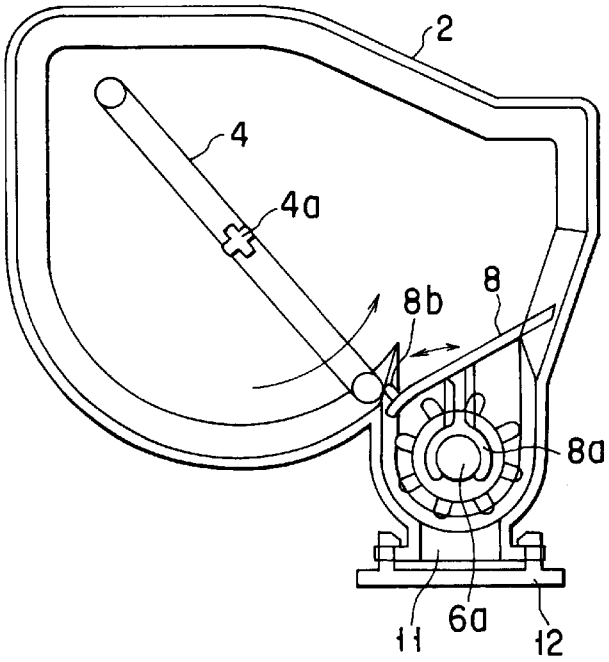
FIG. 4 is a view for explaining the operation of a projection of the plate-like member in FIG. 3A.

Also, as specifically shown in FIGS. 3A and 4, a projection 8*b* which acts on the rotating paddle 4 is provided and projected on the upper surface of the plate-like member 8. The projection 8*b* is preferably provided immediately above the portion where the support arm 8*a* of the plate-like member 8 is attached. Specifically, it is desirable that the position of the projection 8*b* is set such that, when the paddle 4 acts on the projection 8*b*, a vibration thereof is transferred directly to the support arm 8*a* and the plate-like member 8 easily causes a vibration. In the present embodiment, the support arm 8*a* and the projection 8*b* are attached to the substantial center of the plate-like member 8 along the widthwise direction thereof. It is, however, possible to arbitrarily set the position of the projection. Also, in the present embodiment, a margin is maintained between the support arm 8*a* and the rotary shaft 6*a* so that the plate-like member 8 easily vibrates.

Figure 5:
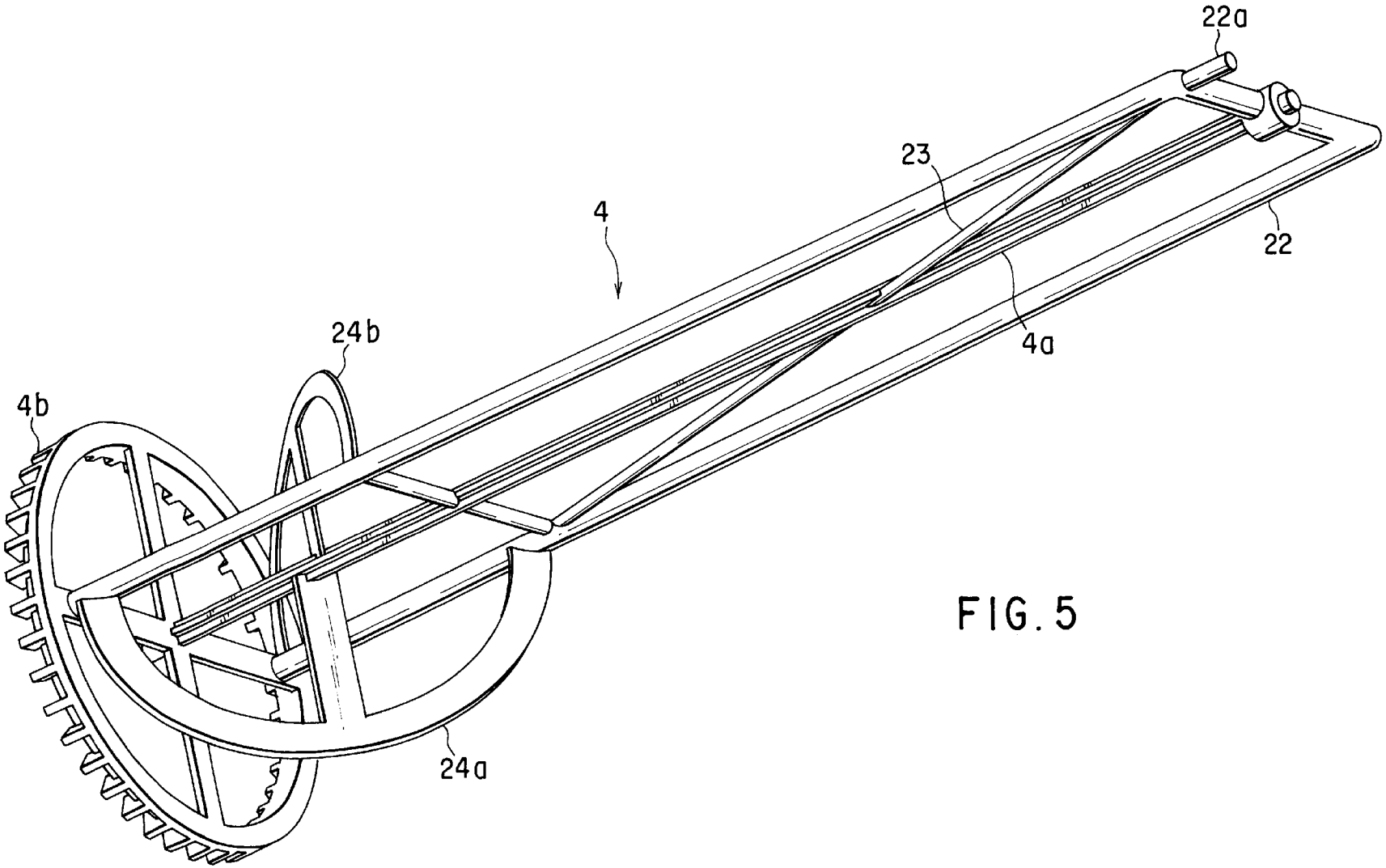
FIG. 5 is a perspective view of the paddle shown in FIG. 1C.

FIG. 5 shows a perspective view of the paddle 4. The paddle 4 is situated near the auger 6 in the obliquely upper side thereof and is provided so as to extend substantially in parallel with the auger 6 in the cartridge body 2. An end of the rotary shaft 4*a* of the paddle 4 is supported rotatably on the bearing 18*a* provided at the substantial center of the concave portion 18 provided at an end 2*a* of the cartridge body 2, and the other end of the rotary shaft 4*a* is received by the bearing 3*a* projected inside the cover member 3.

The paddle 4 includes a stirring member 22 having a substantially rectangular frame-like shape substantially over the total length of the paddle 4, and a rod member 23 connecting the rotary shaft 4*a* with the stirring member 22 and extending obliquely. The stirring member 22 having a substantially rectangular frame-like shape also substantially slides on a inner wall of the cartridge body 2 when the paddle 4 is rotated in a predetermined direction, thereby functioning to stir the toner contained in the cartridge body 2. The stirring member 22 acts on the projection 8*b* projected from the plate-like member 8 during its rotation and vibrates the plate-like member 8. Further, at an end of the stirring member 22, a projection 22*a* is provided which is interposed in a substantially circular groove 25 formed undesirably in the cartridge body 2 outside the substantially circular concave portion 18 provided at the edge 2*a* of the cartridge body 2.

That is, when the paddle 4 is rotated in the predetermined direction by rotation of the auger 6, a portion of the stirring member 22 touches the projection 8*b* of the plate-like member 8 thereby vibrating this member 8, and toner accumulated on the plate-like member 8 then drops downward along the slope of the plate-like member 8. The toner is fed by the paddle 4 and the auger 6 and is supplied through the toner supply port 11. Further, as the paddle 4 rotates, the projection 22*a* projected from an end of the stirring member 22 is rotated along the substantially circular groove 25 provided inside an end of the cartridge body 2 and functions to scrape out toner accumulated in the groove 25.

Two curved stirring blades 24*a* and 24*b* which are substantially semi-elliptic are provided at a position close to the other end side of the paddle 4, i.e., the position opposed to the plate-like member 8. The stirring blades 24*a* and 24*b* respectively have such shapes as obtained by cutting one cylinder in directions obliquely cross each other, and function to feed toner to the end 2*a* side of the cartridge body 2 by rotating the rotary shaft 4*a* of the paddle 4 in a predetermined direction. In other words, the two stirring blades 24*a* and 24*b* function to move toner on the plate-like member 8 to the side of the end 2*a* of the cartridge body 2 and supply the toner to above the first blade 21*a* of the auger 6.

Explained next will be the operation of the toner cartridge 1 according to the first embodiment described above.

The toner cartridge 1 is set at a predetermined position in the apparatus body with toner contained in the cartridge body 2. At this time, a driving shaft of a motor not shown is inserted through the boss portion 16 projected from an end of the cartridge body 2, and the driving shaft of the motor is connected to the rotary shaft 6*a* of the auger 6. At the same time when the cartridge body 2 is attached, the cover member 12 of the toner supply port 11 is opened.

In the state where the toner cartridge 1 is thus set in the apparatus body, if the motor not shown is rotated to rotate the auger 6 in a predetermined direction, a drive torque is transmitted to the paddle 4 through the gear 6*b* provided at another end of the rotary shaft 6*a* of the auger 6 and through the gear 4*b* provided at another end of the rotary shaft 4*b* of the paddle 4, so the paddle 4 is rotated in a predetermined direction together with the auger 6.

As the auger 6 and paddle 4 are respectively rotated in predetermined directions, the toner contained in the cartridge body 2 moves as indicated by the arrow B in FIG. 1A. That is, the toner contained in the cartridge body 2 is fed toward the supply port 11 by the rotation of the auger 6 while being stirred by the rotation of the paddle 4. The toner is then dropped downward through the toner supply port 11 and is supplied to the apparatus body side.

At this time, the plate-like member 8 attached immediately above the toner supply port 11 prevents a large amount of toner from dropping by its own weight through the toner supply port 11. By the stirring blades 24*a* and 24*b*, the toner existing above the plate-like member 8 is fed in the direction in which the toner moves apart from the toner supply port 11, i.e., toward the end 2*a* of the cartridge body 2, and a fixed amount of toner is supplied through the toner supply port 11 in correspondence with the feed ability depending on the rotation speed of the auger 6. That is, by providing the plate-like member 8 inclined above the toner supply port 8 as in the present embodiment, fixed-amount supply of toner corresponding to the feed ability of the auger 6 can be achieved, so the supply amount toner can be stable.

During supply operation of toner, the portion of the stirring member 22 of the paddle 4 acts on the projection 8*b* of the plate-like member 8, so the plate-like member 8 is vibrated continuously. Since the plate-like member 8 is slanted downward toward the paddle 4, the toner accumulated on the plate-like member 8 is efficiently dropped into the paddle 4 as the plate-like member 8 is vibrated. When the paddle 4 is rotated, the projection 22*a* projected from an end of the stirring member 22 is moved along the substantially circular groove 25 provided inside the edge 2*a* of the cartridge body 2, and the toner remaining in the groove 25 is scraped out.

Thus, according to the structure of the present embodiment, when the residual amount of toner in the cartridge body 2 has become small, the toner accumulated on the plate-like member 8 is moved by the stirring blades 24*a* and 24*b* and the plate-like member 8 is vibrated, so toner cannot remain on the plate-like member 8. When the residual amount of the toner has become small, the toner remaining in the substantially circular groove 25 around the toner charge port 17 is scraped out by the projection 22*a* of the paddle 4 and toner cannot remain in the groove 25. Therefore, according to the present embodiment, it is possible to use substantially all amount of toner contained in the toner cartridge 1 without a waste.

Figure 6A:
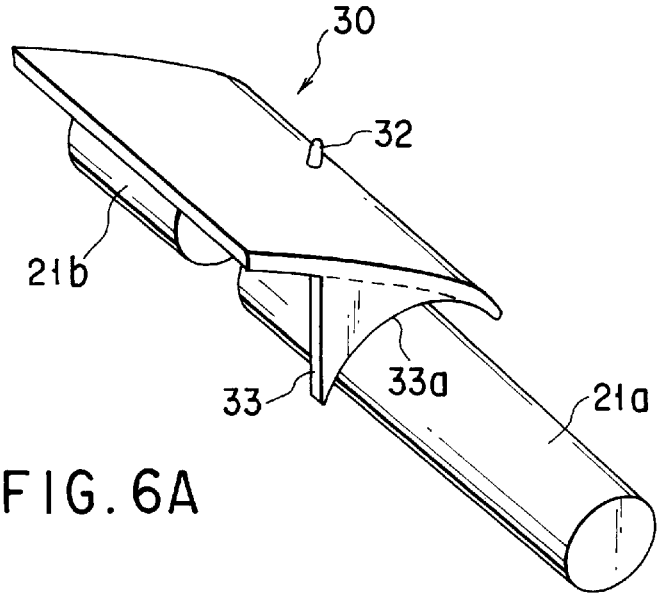
FIG. 6A is a perspective view showing a modification example of the plate-like member.
Figure 6B:
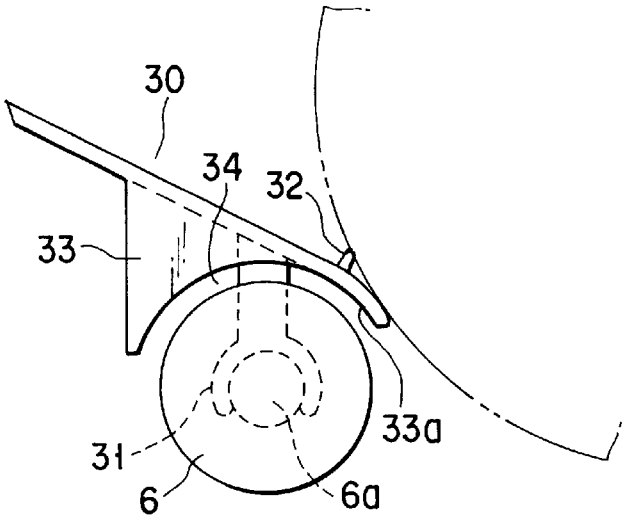
FIG. 6B is a side view of the plate-like member in FIG. 6A viewed from an end side thereof.
Figure 6C:
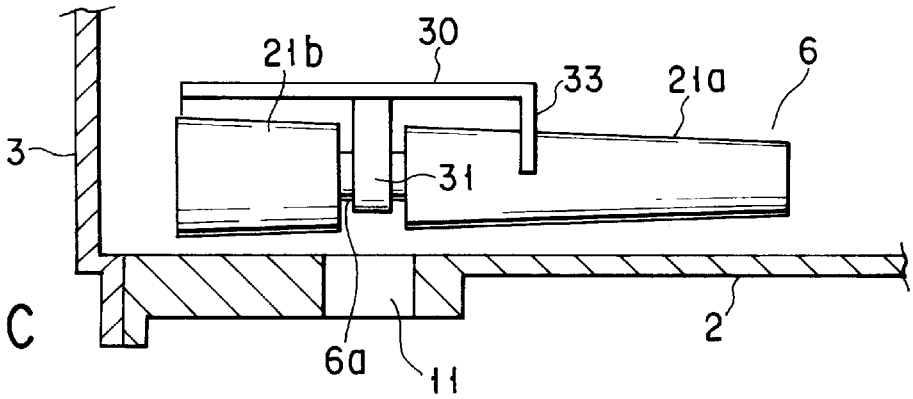
FIG. 6C is a front view showing a state where the plate-like member in FIG. 6A is attached to the auger.

FIGS. 6A to 6C show a modification of the plate-like member 8 described above.

Like the member 8, this plate-like member 30 is inclined immediately above the toner supply port 11 and attached to the rotary shaft 6*a* of the auger 6 through a support arm 31. The plate-like member 30 has a projection 32 which is provided substantially above the support arm 31 and acts on the paddle 4, like in the above-described embodiment. Further, the plate-like member 30 integrally includes a regulation plate 33 (wall member) projected downward toward the first blade 21*a* from one end along the rotary shaft 6*a* of the auger 6.

An edge 33*a* where the regulation plate 33 is opposed to the first blade 21*a* of the auger 6 is formed in a arc-like shape concentric to the auger 6, and an slight arc-like clearance 34 is formed between the curved edge 33*a* and the first blade 21*a*. That is, the plate-like member 30 is provided not to contact the auger 6 with the arc-like clearance 34 interposed therebetween.

Thus, since the regulation plate 33 opposed to the auger 6 is projected at an end of the plate-like member 30 toward the auger 6 with the arc-like clearance 34 interposed therebetween, the feed amount of toner to be fed toward the toner supply port 11 by the operation of the first blade 21*a* can be regulated at a constant amount, so the feed amount of toner can be stabilized further. In this modification, the regulation plate 33 is provided only at the one end side of the plate-like member 30 to which toner is fed because the feed of toner is deviated substantially into one direction. However, in the case where toner is fed from both sides toward the toner supply port 11 by an auger as in second and third embodiments which will be described later, it may be considered that the similar regulation plate should be provided also at another end of the plate-like member.

Figure 7C:
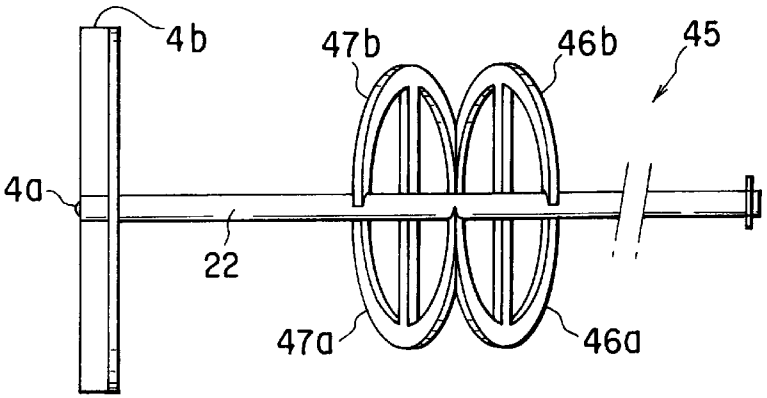
FIG. 7C is a plan view showing a paddle attached in the toner cartridge shown in FIG. 7A.

Next, a toner cartridge 40 according to the second embodiment of the present invention will be explained with reference to FIGS. 7A to 7C. Note that those structural elements which have the same functions as those of the toner cartridge 1 in the above-described first embodiment will be designated at the same reference symbols, and detailed descriptions thereof will be omitted herefrom.

The toner cartridge 40 of the present embodiment comprises a cartridge body 41 including a toner supply port 11 which is more deviated to the center in the lengthwise axis direction in comparison with the toner cartridge 1 of the first embodiment. In this cartridge body 41, there is provided an auger 43 including first and second blades 42*a* and 42*b* whose lengths are adjusted to correspond to the position of the toner supply port 11. More specifically, the lengths of the first and second blades 42*a* and 42*b* of the auger 43 are adjusted such that the rotary shaft 43*a* of the auger 43 exposed between the first and second blades 42*a* and 42*b* is situated immediately above the toner supply port 11.

A plate-like member 44 having the substantially same shape as that of the first embodiment is attached on the exposed rotation shaft 43*a* of the auger 43, inclined also like the first embodiment. The plate-like member 44 has such a width along the axial direction that makes the length of a part overlapping the first blade 43*a* of the auger 43 and the length of another part overlapping the second blade 43*b* substantially equal to each other. Although the widths by which the plate-like member 44 overlaps the first and second blades 43*a* and 43*b* are set appropriately in correspondence with the fluidity of toner and the position of the toner supply port 11 in the axis direction, the length of the part overlapping the first blade 43*a* and the length of the part overlapping the second blade 43*b* are set to a substantially equal length in this embodiment.

Also, the paddle 45 incorporated in the toner cartridge 40 comprises two sets of stirring blades 46*a*, 46*b*, 47*a* and 47*b*, which are positioned in compliance with the position of the toner supply port 11 of the cartridge body 41 in the lengthwise axis direction. Each set of the stirring blades are formed like the stirring blades 24*a* and 24*b* described previously, and provided close to each other kept in a positional relationship that the toner supply port 11 is sandwiched therebetween.

The set of the stirring blades 46*a* and 46*b* which are provided close to the first blade 42*a* of the auger 43 function to feed toner existing above the plate-like member 44 to the side of an end 2*a* of the cartridge body 41 similarly to the stirring blades 24*a* and 24*b*. The other set of stirring blades 47*a* and 47*b* provided close to the second blade 42*b* function to feed the toner existing above the plate-like member 44 to the opposite side. That is, the sets of the stirring blades are attached in opposite directions and function to feed the toner existing above the plate-like member 44 in opposite directions when the paddle 45 is rotated in a predetermined direction.

Figure 7A:
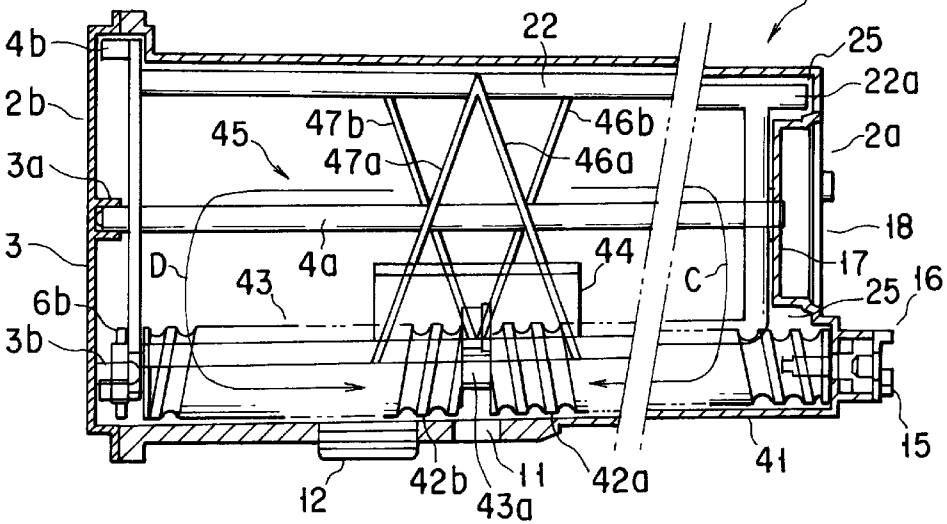
FIG. 7A is a front view showing an inner structure of a toner cartridge according to a second embodiment of the present invention.
Figure 7B:
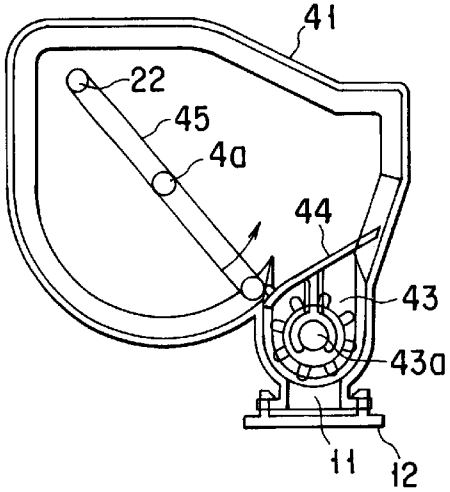
FIG. 7B is a side view of the toner cartridge shown in FIG. 7A as viewed from an end side thereof.

Specifically, in the toner cartridge 40 of the present embodiment, when the auger 43 and paddle 45 are respectively rotated in predetermined directions, the toner contained in the cartridge body 41 is moved in the direction shown with the arrows C and D in FIG. 7A and fed to the first and second blades 42*a* and 42*b* of the auger 43. The toner is then collected from both sides due to the operation of the first and second blades 42*a* and 42*b* and supplied through the toner supply port 11.

As described above, since the plate-like member 44 is provided above the toner supply port 11 also in the present embodiment, the same effect as the first embodiment described above can be obtained. Also, according to the present embodiment, the toner can be fed from the both sides in the axial direction through the toner supply port 11 arranged closer to the center in the axial direction, it is also possible to increase the toner supply amount in comparison with the first embodiment. Further, in the present embodiment, if a regulation plate 33 shown in FIG. 6A is attached to the plate-like member 44, it is preferable that regulation plates should be provided on both sides of the plate-like member 44.

Figure 8A:
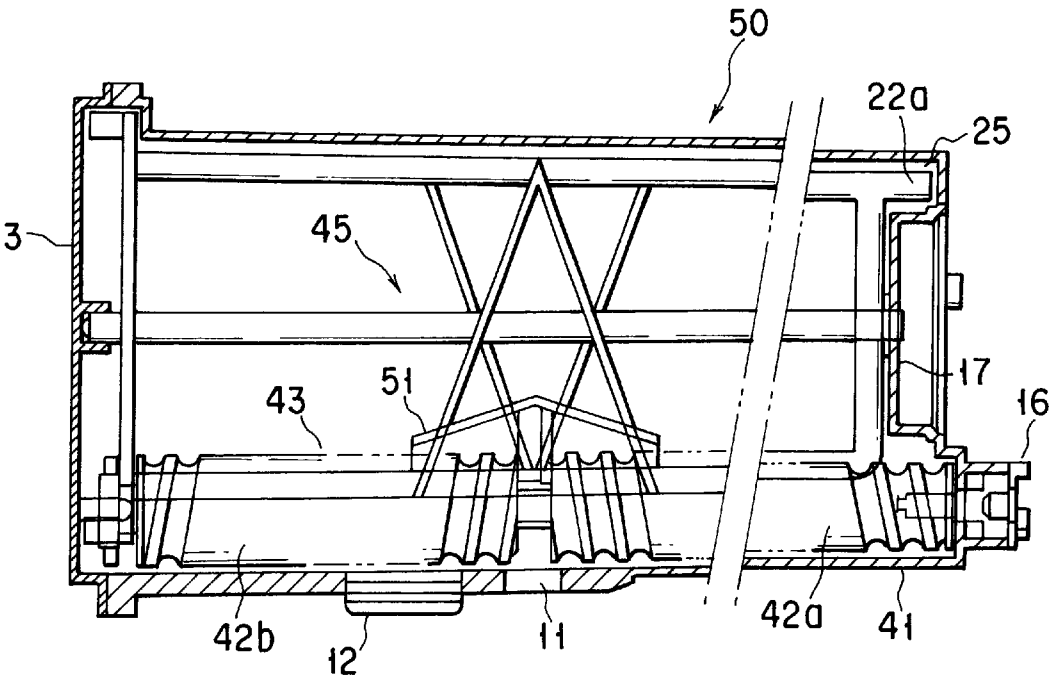
FIG. 8A is a front view showing an inner structure of a toner cartridge according to a third embodiment of the present invention.
Figure 8B:
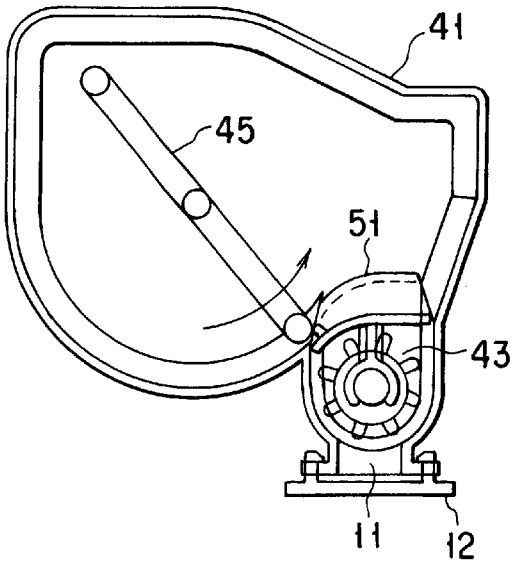
FIG. 8B is a side view of the toner cartridge in FIG. 8A as viewed from an end side thereof.

FIGS. 8A and 8B show a toner cartridge 50 according to a third embodiment of the present embodiment. The toner cartridge 50 of the present embodiment comprises substantially the same structure as the toner cartridge 40 of the second embodiment except that the shape of a plate-like member 51 is different from that of the plate-like member 44 of the second embodiment. Therefore, the structural elements which function in the same way as the second embodiment will be designated at the same reference symbols as those used in the second embodiment, and detailed descriptions thereof will be omitted herefrom.

The plate-like member 51 is slanted downward toward the paddle 45 along a direction perpendicular to the rotary shaft 43*a* of the auger 43 and also toward the first and second blades 42*a* and 42*b* from the toner supply port 11 as a boundary. That is, if the plate-like member 51 of the present embodiment is used, toner existing above the plate-like member 51 is dropped in a direction toward the paddle 45 and also onto the first and second blades 42*a* and 42*b* of the auger 43.

Therefore, according to the present embodiment, the same effects as those of the first and second embodiments can be obtained, and further, the toner existing above the plate-like member 51 can be dropped more efficiently in comparison with the second embodiment. Needless to say, the plate-like member 51 comprises a projection which acts on the paddle 45 also in the present embodiment.

Note that the present invention should not be limited to the first to third embodiments but can be modified variously within the scope of the present invention. For example, the above-described embodiments have explained cases that a plate-like member provided above a toner supply port is attached rotatably on a rotary shaft of an auger. However, the plate-like member may also be attached in the cartridge body side. In this case, the plate-like member may be fixed to the cartridge body or may be attached rotatably by a hinge member or the like. Any material is acceptable for the plate-like member, e.g., the material may be a thin metal piece, a resinous film, or the like.

Although each of the above embodiments is arranged such that a portion of a rotating paddle acts on a projection of a plate-like member thereby to vibrate the plate-like member, it is also possible that a portion of a rotating auger is let act on a projection of the plate-like member to vibrate this member, for example.

What is claimed is:

1. A toner cartridge set in an apparatus body, comprising:

a container containing toner;

a supply port provided at a bottom of the container, for dropping the toner in the container in a gravity direction, wherein the toner is supplied to the apparatus body;

an auger provided in the container so as to extend immediately above the supply port in a substantially horizontal direction, for feeding the toner in the container toward the supply port along a lengthwise direction thereof; and a regulation member provided above the auger at a position opposed to the supply port, for regulating drop of the toner in the container toward the apparatus body through the supply port due to dead weight of the toner, wherein the toner cartridge is exchangeably set in the apparatus body.

2. A toner cartridge according to claim 1, wherein the regulation member has a plate-like member extending along a substantially horizontal plane.

3. A toner cartridge according to claim 2, wherein the plate-like member is inclined downward toward the auger.

4. A toner cartridge according to claim 2, wherein the plate-like member is inclined in a direction crossing a rotary axis of the auger.

5. A toner cartridge according to claim 2, wherein the auger includes a rotary shaft extending immediately above the supply port, a spiraled first blade formed from an end of the rotary shaft toward the supply port, and a second blade formed from another end of the rotary shaft toward the supply port and spiraled in a direction opposite to that of the first blade, and no spiral blade is formed at a part of the auger which is situated between the first and second blades immediately above the supply port and opposed thereto, the rotary shaft is exposed therefrom, and the plate-like member is provided immediately above the rotary shaft thus exposed.

6. A toner cartridge according to claim 2, wherein the plate-like member is attached to the container.

7. A toner cartridge comprising:

a container containing toner;

a supply port provided at a bottom of the container, for dropping the toner in the container in a gravity direction;

an auger provided in the container so as to extend immediately above the supply port in a substantially horizontal direction, for feeding the toner in the container toward the supply port along a lengthwise direction thereof; and a regulation member provided above the auger at a position opposed to the supply port, for regulating drop of the toner in the container toward the supply port due to dead weight of the toner, wherein the regulation member has a plate-like member extending along a substantially horizontal plane;

wherein the auger includes a rotary shaft extending immediately above the supply port, a spiraled first blade formed from an end of the rotary shaft toward the supply port, and a second blade formed from another end of the rotary shaft toward the supply port and spiraled in a direction opposite to that of the first blade;

no spiral blade is formed at a part of the auger which is situated between the first and second blades immediately above the supply port and opposed thereto, the rotary shaft is exposed therefrom, and the plate-like member is provided immediately above the rotary shaft thus exposed; and wherein the plate-like member is rotatably attached to the rotary shaft exposed between the first and second blades.

8. A toner cartridge according to claim 7, wherein a wall member for limiting an amount of toner fed toward the supply port by the auger is provided at, at least, one end portion of the plate-like member along the rotary shaft, and is extended toward the auger.

9. A toner cartridge according to claim 8, wherein a clearance in form of an arc concentric to the rotary shaft of the auger is formed between the wall member and the auger.

10. A toner cartridge set in an apparatus body, comprising:

a container containing toner;

a supply port provided at a bottom of the container, for dropping the toner in the container in a gravity direction, wherein the toner is supplied to the apparatus body;

an auger provided in the container so as to extend immediately above the supply port in a substantially horizontal direction, for feeding the toner in the container, toward the supply port along a lengthwise direction thereof;

a regulation member provided above the auger at a position opposed to the supply port, for regulating drop of the toner in the container toward the apparatus body through the supply port due to dead weight of the toner; and a stirring member for stirring the toner in the container and for moving the toner existing above the regulation member along a lengthwise direction of the auger in a direction in which the toner moves apart from the regulation member, wherein the toner cartridge is exchangeably set in the apparatus body.

11. A toner cartridge according to claim 10, wherein the regulation member has a plate-like member extending along a substantially horizontal plane.

12. A toner cartridge according to claim 11, wherein the stirring member has a rotary shaft extended substantially in parallel with the auger along the lengthwise direction of the auger, and at least one stirring blade attached to the rotary shaft to feed the toner existing above the plate-like member along the rotary shaft in a direction in which the toner moves apart from the plate-like member.

13. A toner cartridge according to claim 12, wherein the plate-like member has a projection which acts on the stirring member.

14. A toner cartridge according to claim 13, wherein the plate-like member is inclined downward toward the auger.

15. A toner cartridge according to claim 13, wherein the plate-like member is inclined downward toward the stirring blade of the stirring member.

16. A toner cartridge according to claim 11, wherein the auger includes a rotary shaft extending immediately above the supply port, a spiraled first blade formed from an end of the rotary shaft toward the supply port, and a second blade formed from another end of the rotary shaft toward the supply port and spiraled in a direction opposite to that of the first blade, and no spiraled blade is formed at a part of the auger which is situated between the first and second blades immediately above the supply port and opposed thereto, the rotary shaft is exposed therefrom, and the plate-like member is provided immediately above the rotary shaft thus exposed.

17. A toner cartridge comprising:

a container containing toner;

a supply port provided at a bottom of the container, for dropping the toner in the container in a gravity direction;

an auger provided in the container so as to extend immediately above the supply port in a substantially horizontal direction, for feeding the toner in the container, toward the supply port along a lengthwise direction thereof;

a regulation member provided above the auger at a position opposed to the supply port, for regulating drop of the toner in the container toward the supply port due to dead weight of the toner; and a stirring member for stirring the toner in the container and for moving the toner existing above the regulation member along a lengthwise direction of the auger in a direction in which the toner moves apart from the regulation member, wherein the regulation member has a plate-like member extending along a substantially horizontal plane;

wherein the auger includes a rotary shaft extending immediately above the supply port, a spiraled first blade formed from an end of the rotary shaft toward the supply port, and a second blade formed from another end of the rotary shaft toward the supply port and spiraled in a direction opposite to that of the first blade;

no spiraled blade is formed at a part of the auger which is situated between the first and second blades immediately above the supply port and opposed thereto, the rotary shaft is exposed therefrom, and the plate-like member is provided immediately above the rotary shaft thus exposed; and wherein the plate-like member is rotatably attached to the rotary shaft exposed between the first and second blades, with a margin provided with respect to the rotary shaft.

18. A toner cartridge according to claim 17, wherein the stirring member has a rotary shaft extended substantially in parallel with the auger along the lengthwise direction of the auger, and at least one stirring blade attached to the rotary shaft, for feeding the toner existing above the plate-like member along the rotary shaft in a direction in which the toner moves apart from the plate-like member.

19. A toner cartridge according to claim 18, wherein the plate-like member has a projection which acts on the stirring member.

20. A toner cartridge according to claim 19, wherein the projection is provided near a portion where the plate-like member is attached to the rotary shaft.

21. A toner cartridge according to claim 18, wherein a wall member for limiting an amount of toner fed toward the supply port by the auger is provided at, at least, one end portion of the plate-like member along the rotary shaft, and is extended toward the auger.

22. A toner cartridge according to claim 21, wherein an clearance in form of an arc concentric to the rotary shaft of the auger is formed between the wall member and the auger.

23. A toner cartridge set in an apparatus body, comprising:

a substantially cylindrical container containing toner;

a charge port formed at a bottom portion of a substantially circular concave recessed to inside of the container from an end of the container along a lengthwise direction of the container extending in a substantially horizontal direction;

a supply port provided at a bottom of the container, for dropping the toner in the container in a gravity direction, wherein the toner is supplied to the apparatus body;

an auger provided in the container so as to extend immediately above the supply port in the substantially horizontal direction along the lengthwise axis and having an end rotatably supported on the end of the container, for feeding the toner in the container toward the supply port along the lengthwise direction;

a regulation member provided above the auger at a position opposed to the supply port, for regulating drop of the toner in the container toward the apparatus body through the supply port due to dead weight of the toner; and a stirring member extended substantially in parallel with the auger through inside the container and having a rotary shaft rotatably supported, at an end thereof, on a substantially central position of the bottom portion of the concave, for stirring the toner in the container by rotating the rotary shaft, wherein the stirring member has a projection which acts on a groove provided outside the concave in the container vessel as the stirring member rotates, wherein the toner cartridge is exchangeably set in the apparatus body.

24. A toner cartridge according to claim 23, wherein the regulation member has a plate-like member extending along a substantially horizontal plane.

25. A toner cartridge according to claim 24, wherein the stirring member has at least one stirring blade for moving the toner existing above the plate-like member along the rotary shaft in a direction in which the toner moves apart from the plate-like member, as the stirring member rotates.

26. A toner cartridge according to claim 25, wherein the plate-like member has a projection which acts on the stirring member.

27. A toner cartridge according to claim 26, wherein the plate-like member is inclined to a horizontal plane.

* * * * *